United States Patent [19]

Howatt

[11] 4,055,111

[45] Oct. 25, 1977

[54] ENVELOPE MACHINE

[75] Inventor: George F. Howatt, Holden, Mass.

[73] Assignee: New England Envelope Manufacturing Co., Worcester, Mass.

[21] Appl. No.: 688,617

[22] Filed: May 21, 1976

Related U.S. Application Data

[60] Division of Ser. No. 543,676, Jan. 24, 1975, Pat. No. 3,982,472, which is a division of Ser. No. 487,906, July 12, 1974, Pat. No. 3,869,965, which is a continuation of Ser. No. 335,725, Feb. 26, 1973, abandoned.

[51] Int. Cl.[2] ..... B31B 1/08

[52] U.S. Cl. ..... 93/61 R; 271/197

[58] Field of Search ..... 93/61 R, 61 A, 62; 271/197, 276

[56] References Cited

U.S. PATENT DOCUMENTS

| | | | |
|---|---|---|---|
| 2,859,672 | 11/1958 | Triolo | 93/61 R |
| 3,288,037 | 11/1966 | Burnett | 93/61 R |
| 3,564,738 | 2/1971 | Batzdorff et al. | 271/197 X |
| 3,672,667 | 6/1972 | Pahlitsch | 271/197 |
| 3,823,937 | 7/1974 | Hirafuji | 271/197 X |

*Primary Examiner*—James F. Coan

*Attorney, Agent, or Firm*—Norman S. Blodgett; Gerry A. Blodgett

[57] ABSTRACT

Envelope machine of the window-applicator type and means for avoiding application of gum to window when envelope blank is missing and to dispose of the window under similar circumstances.

1 Claim, 17 Drawing Figures

FIG. 4
STEP E
APPLY WINDOW
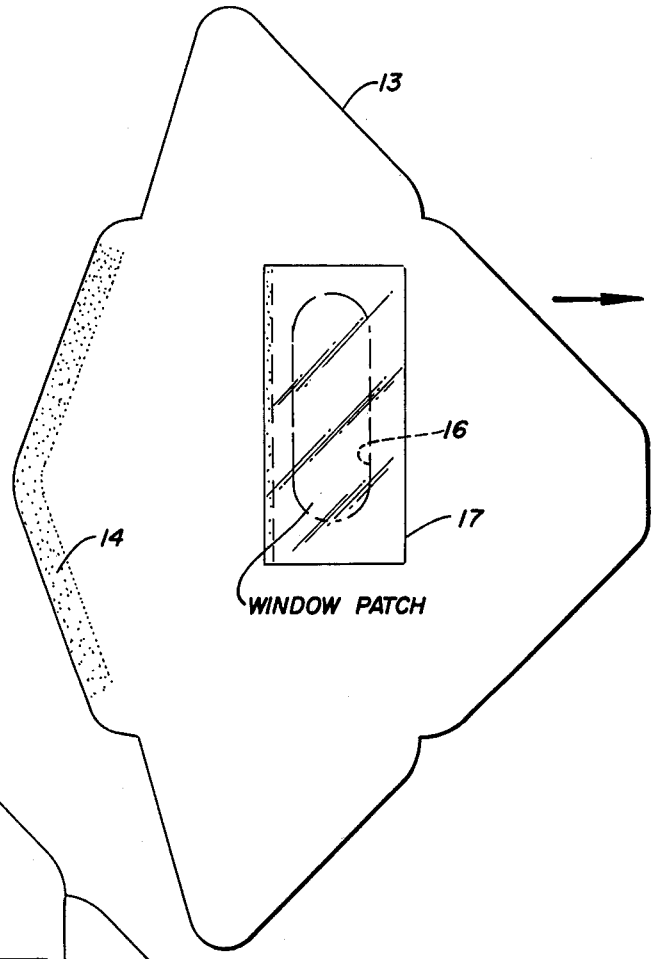
STEP F
SCORE TOP & BOTTOM FLAPS
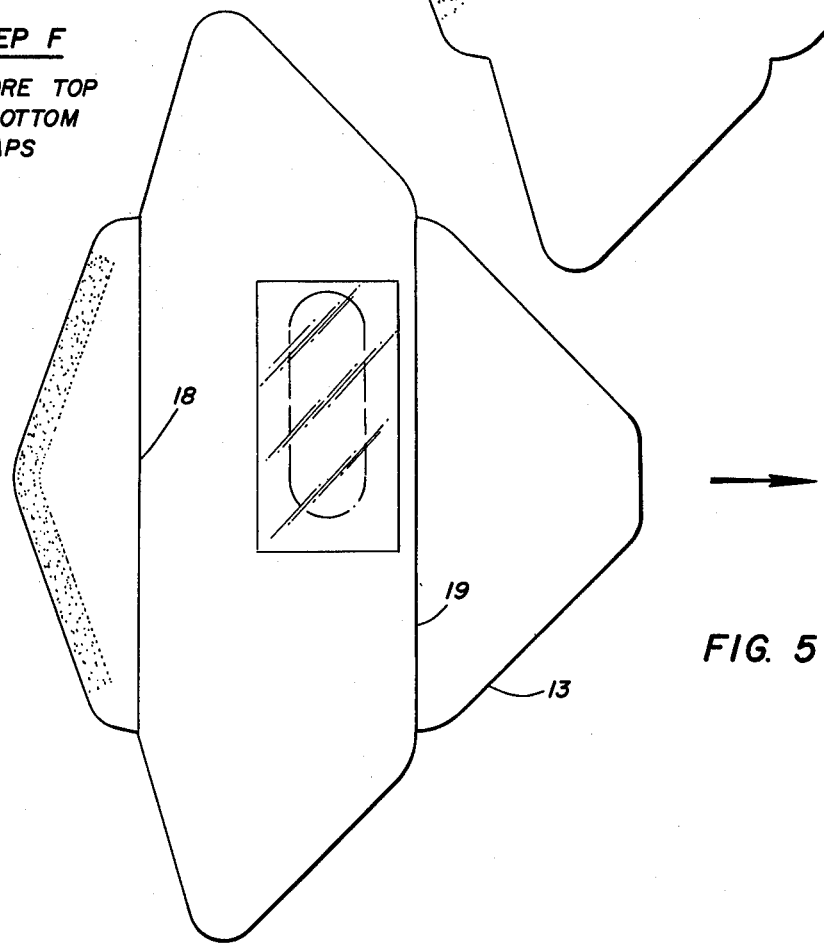
FIG. 5

STEP G

SCORE SIDE FLAPS

STEP H

FOLD SIDE FLAPS

ENVELOPE MACHINE

This is a division of application Ser. No. 543,676 filed Jan. 24, 1975 now U.S. Pat. No. 3,982,472, which in turn is a division of application Ser. No. 487,906 filed July 12, 1974, now U.S. Pat. No. 3,869,965 which in turn is a continuation of application Serial No. 335,725 filed Feb. 26, 1973, now abandoned.

BACKGROUND OF THE INVENTION

In the design and operation of envelope making machine every effort is made to speed up the machine and to prevent shut downs during the working day. This is true in envelope making as in other industries, mainly because the envelope machine represents a large capital investment whose time should always be used where at all possible in the production of envelopes, and furthermore, in which as many envelopes as possible are produced in a unit time. Not only does the capital cost of the machine enter into this, but also the cost of labor for the operator. One problem that has constantly inhibited the speed up and continuous operation of those envelope making machines which specialize in window-type envelopes, is that the equipment which applies gum to the envelope blank before the window is applied continues to operate even in those instances when an envelope is missing. This means the roller on which the envelope blank normally would be carried would receive a layer of gum which would in turn be applied to subsequent envelope blanks and this would cause a sticking and disruption of operation further on downstream in the machine. To prevent this, it has been necessary to provide a complex and troublesome water box apparatus to wash the roller. Furthermore, difficulty would also be experienced in those machines when an envelope blank is missing because of the fact that the apparatus which introduces the windows dispenses a window even when the envelope blank is missing. This means that a window without an envelope would appear downstream in the machine and cause disruption of the subsequent operations. For that reason, it has been necessary to provide a vacuum roller underlying the window dispensing roller and this roller must be carefully adjusted at all times both sideways and lengthwise. In general, the problem of the gum applicators operating when an envelope blank is missing from the stream is common to all envelope making machines as is the problem of windows being introduced without an envelope blank; although devices have been designed and used in the past to skip the gumming operation when an envelope blank is missing and to remove the loose windows when a window is missing, the equipment has been cumbersome and slow in operation, thus slowing down the speed of the envelope machine. Furthermore, the complications of the mechanism introduced has made it difficult to adjust the gum applicator and the window dispenser when the type of envelope being made is changed. These and other difficulties experienced in the prior art devices have been obviated in a novel manner by the present invention.

It is, therefore, an outstanding object of the invention to provide an envelope machine in which the gum is not picked up or applied when an envelope blank is missing, thus greatly simplifying the apparatus and making the machine easier to adjust.

Another object of this invention is the provision of an envelope machine having simple means for removing a window patch from the stream when its presence is likely to produce mis-operation of the machine.

A further object of the present invention is the provision of simple apparatus for producing window-type envelopes in which means is provided to prevent disruption of machine operation due to an envelope blank being missing from the stream.

It is another object of the instant invention to provide an envelope machine of trouble-free nature for producing windowed envelopes in which the window gum is not applied when an envelope blank is missing from the stream.

A still further object of the invention is the provision of an envelope machine of simple construction for producing windowed envelopes in which, when an envelope blank is missing from the stream, the window which normally would be applied to the missing envelope blank is removed from the stream.

It is a further object of the invention to provide an envelope machine in which gum is not supplied to any parts of the machine adjacent the envelope-making portions when an envelope blank is missing from the stream.

It is a still further object of the invention to provide an envelope machine of simple and trouble-free construction in which disruption of machine operation due to gumming of parts and the presence of an excess window patch is avoided.

With these and other objects in view, as will be apparent to those skilled in the art, the invention resides in the combination of parts set forth in the specification and covered by the claims appended hereto.

SUMMARY OF THE INVENTION

In general, the invention consists of an envelope machine having a frame and a conveyor for carrying envelope blanks longitudinally of the frame. The primary shaft is rotated around an end which extends transversely in the frame above the conveyor and it is driven in synchronization therewith. The secondary shaft is rotatably mounted on the primary shaft with its axis parallel to and spaced from that of the primary shaft. A gum applicator is fastened to the secondary shaft and takes part, not only in its rotation with the primary shaft, but also in its rotation about its own axis. Means is provided for producing the said rotation to the secondary shaft to move the applicator from an operative position wherein rotation of the primary shaft causes the applicator to engage an envelope blank on the conveyor to an inoperative position wherein the applicator does not strike the conveyor.

Also, a second conveyor is mounted in the frame with the discharge end of the first conveyor being spaced from the input end of the second conveyor to find a gap therebetween. A sensor is located over the gap to determine the presence of an envelope blank or the lack of it and a pneumatic jet is directed at a portion of the gap to force unwanted envelope parts downwardly through the gap.

In another version of the window patch disposal unit, the roller around which the first conveyor passes is provided with suction apertures which carry the patch around to the underside of the conveyor where the patch drops into a container.

More specifically, the means for producing the said rotation of the secondary shaft consists of a solenoid, a lever operated by the solenoid, a plurality of bearing balls arranged in a line engaged with one end by the lever for its engagement on one end by the lever and an abutment on the secondary shaft engaged by the other end of the line.

BRIEF DESCRIPTION OF THE DRAWINGS

The character of the invention, however, may be best understood by reference to one of its structural forms, as illustrated by the accompanying drawings, in which:

FIGS. 2-10 show an envelope blank and window in various stages of construction.

DESCRIPTION OF THE PREFERRED EMBODIMENT

Figure 1:
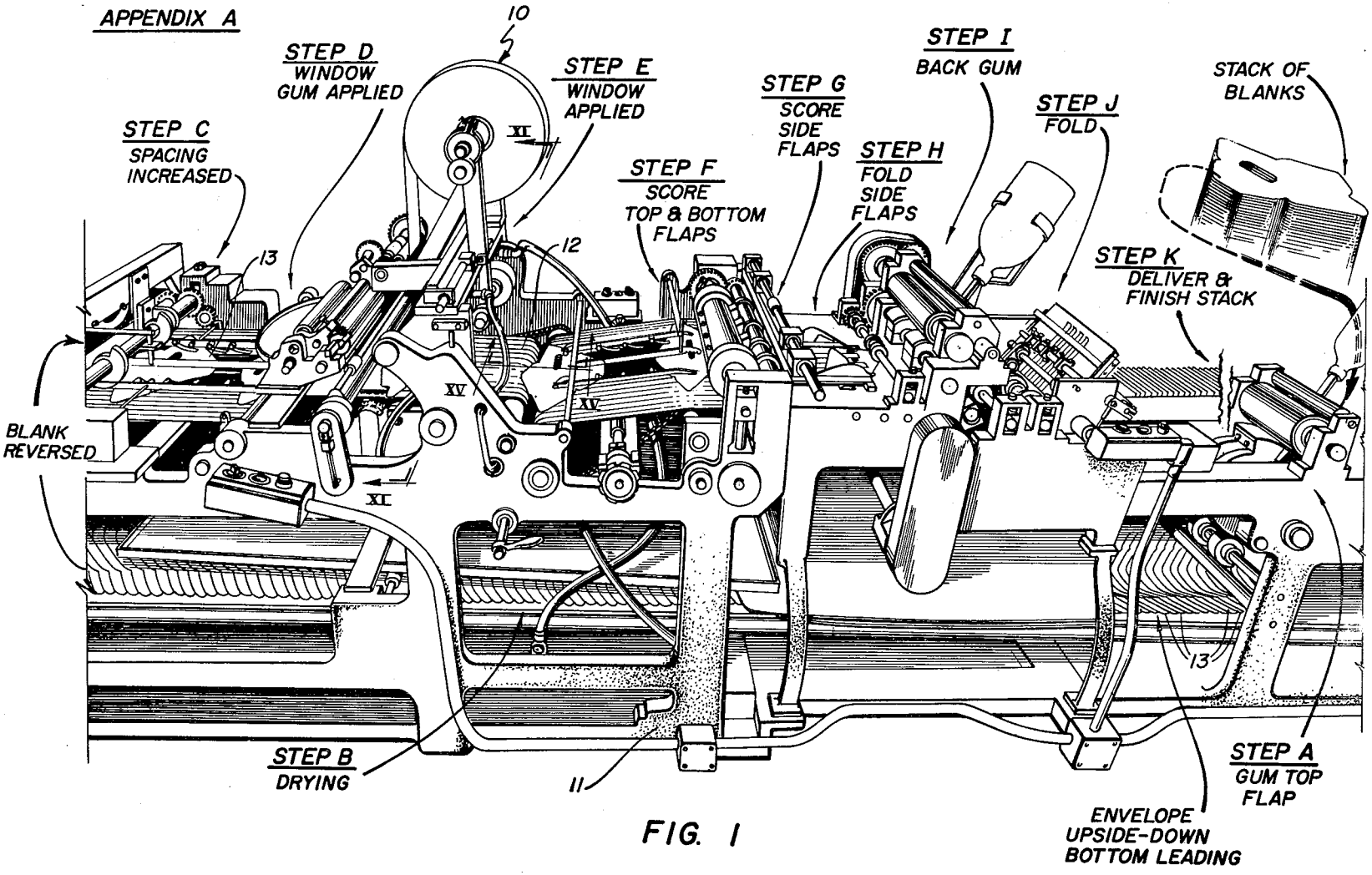
FIG. 1 is a perspective view of an envelope machine embodying the principles of the present invention.

Referring first to FIG. 1 wherein are best shown the general features of the invention, it can be seen that the envelope machine indicated generally by the reference numeral 10, consists of a frame 11 and a conveyor 12 for carrying envelope blanks 13 longitudinally of the frame.

Figure 2:
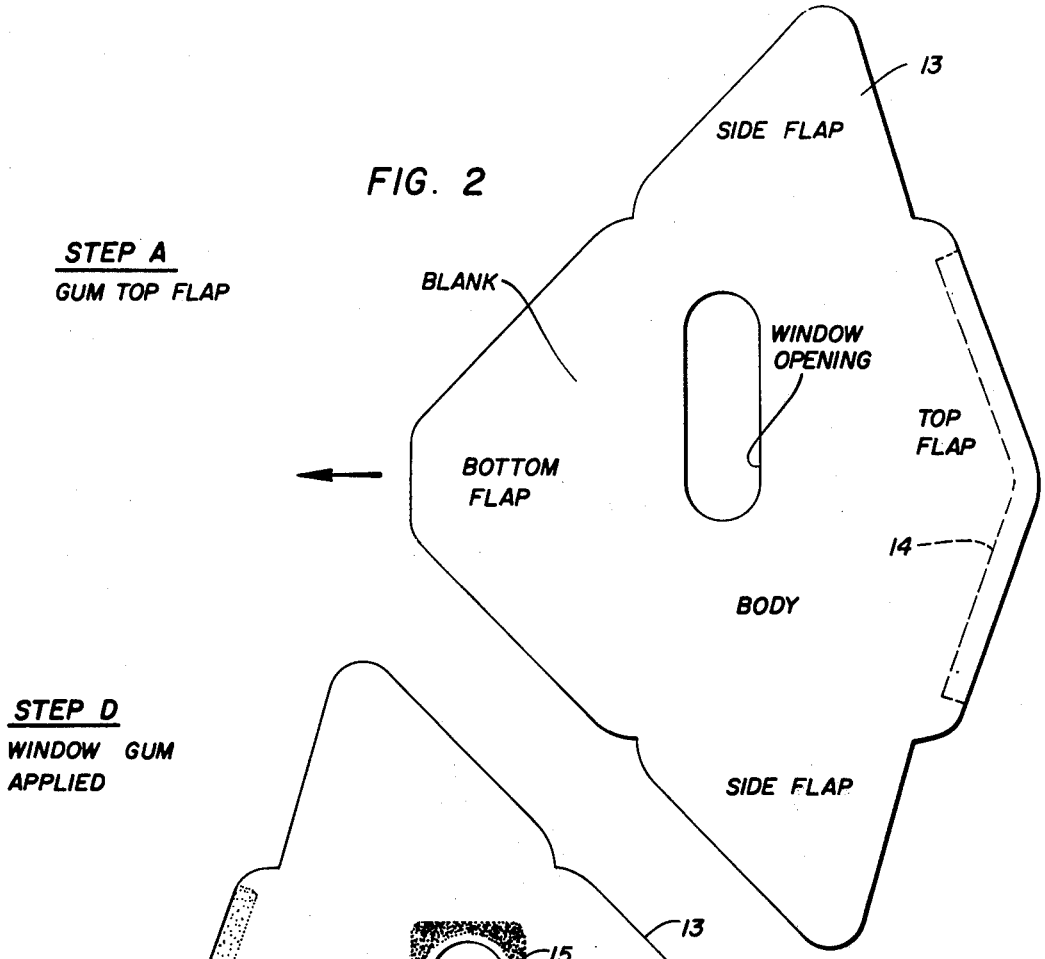

In order to understand the operation of the machine, it is first necessary to discuss in general the manner in which an envelope is formed. FIG. 2 shows the condition of the envelope blank 13 after step A where a gummed portion 14 formed on the blank during step A. The envelope blanks are carried along the bottom of the frame 11 on a conveyor upside down with the bottom of the envelope leading the motion as in the condition shown in FIG. 2. The gummed portion 14 is dried in step B and the blank is reversed at the end of the machine. In step C rollers are used to increase the space between the envelopes which are now moving along the top of the frame with the bottom of the flap leading but now with the gummed portion 14 facing upwardly.

Figure 3:
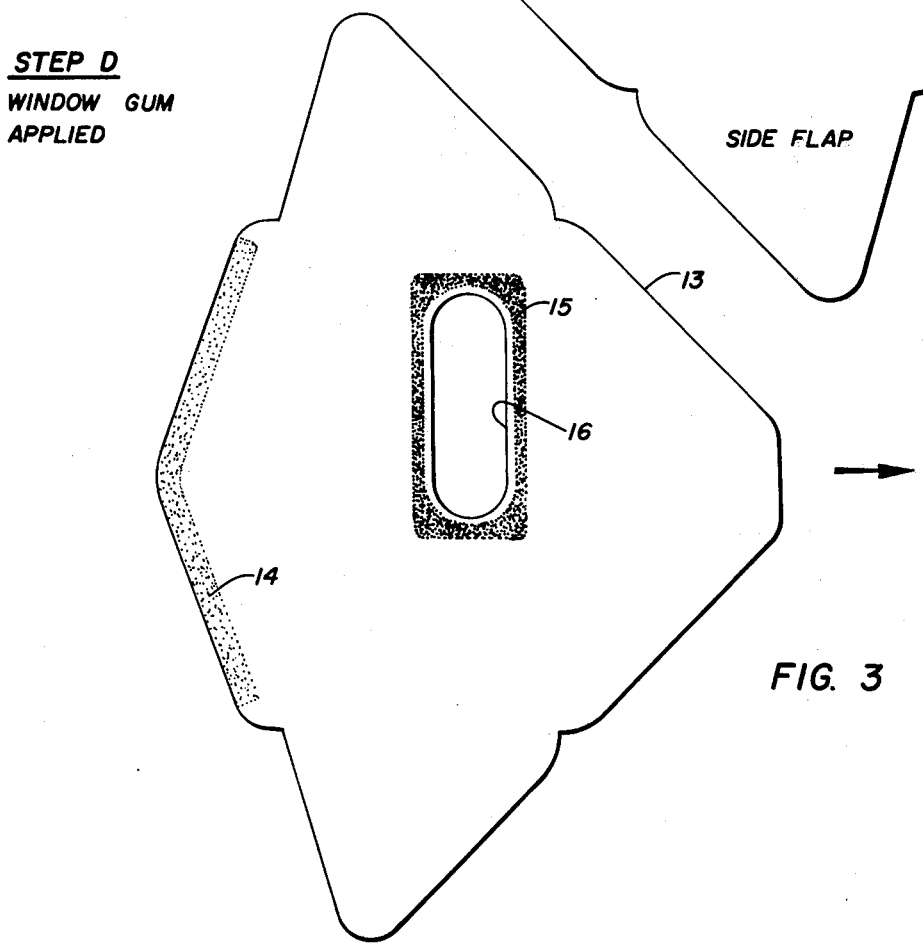

Referring to FIG. 3, it can be seen that step D involves the application of the gummed portion 15 around the window 16.

In step E in FIG. 4, it can be seen that a window patch 17 is applied to the window and it is held by the gummed portion 15.

In FIG. 5 step F is shown as involving the provision of scores 18 and 19 to define the top and bottom flaps.

Figure 6:
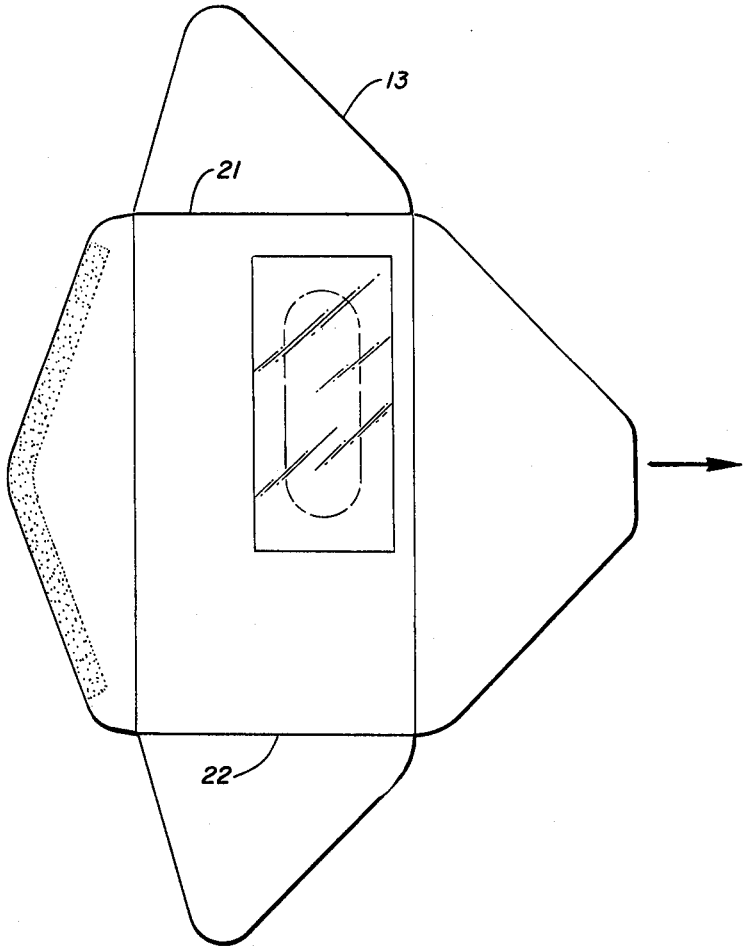

In FIG. 6 step G is shown as the provision of scores 21 and 22 to define the side flaps.

Figure 7:
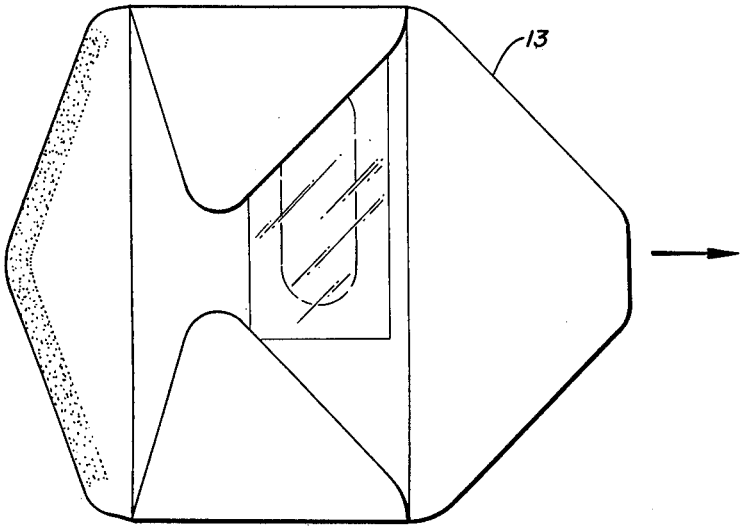

In FIG. 7 step H is carried out and this involves folding the side flaps inwardly about the score lines.

Figure 8:
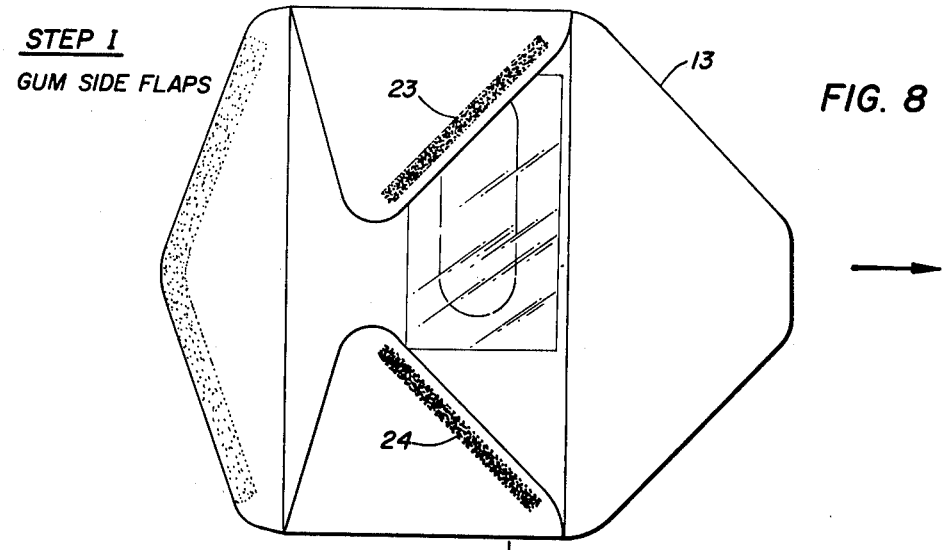

In FIG. 8 the side flaps are provided with gummed portions 23 and 24. These gummed portions are known as the "back gum".

Figure 9:
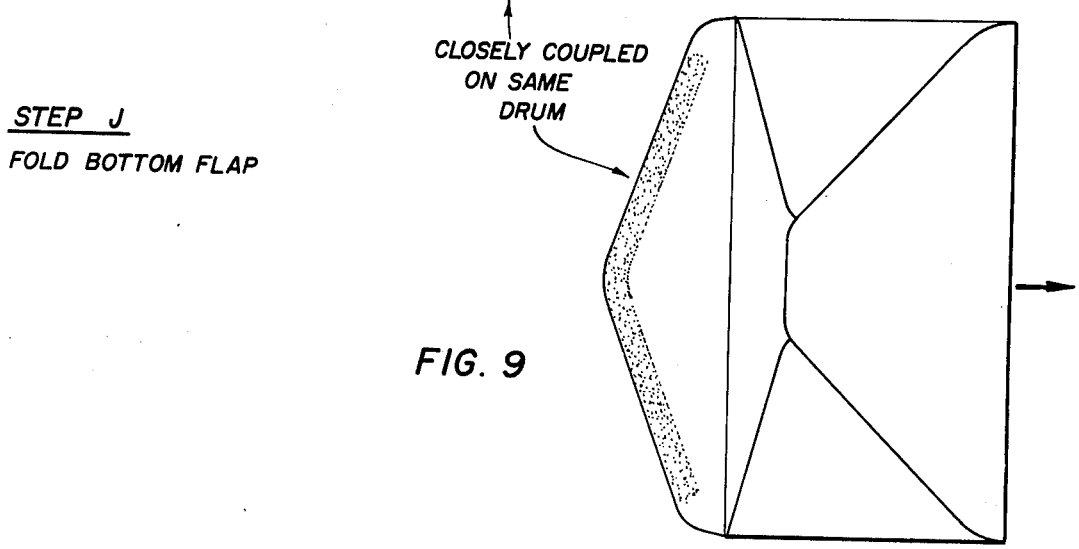

In FIG. 9 step J is carried out whereby the bottom flap is folded up and is held in place by the gummed portions 23 and 24.

Figure 10:
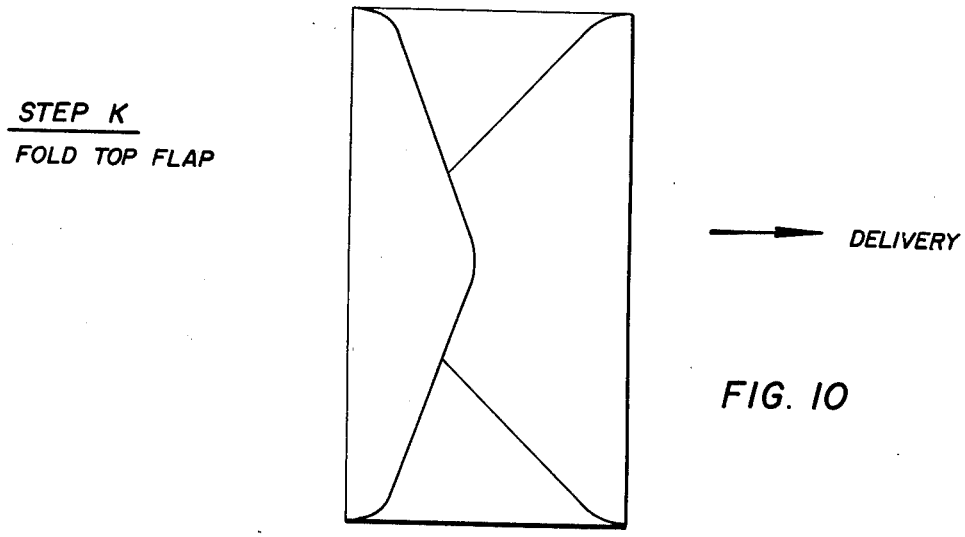

Finally, as is shown in FIG. 10, step K is carried out and the envelope is then delivered to an assembly area where it is placed in boxes.

Figure 11:
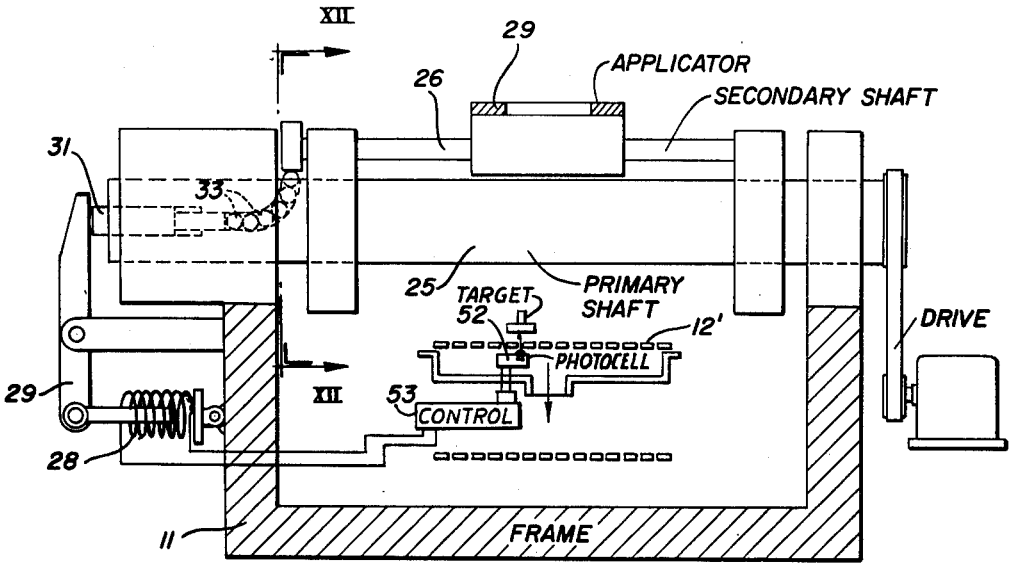
FIG. 11 is a transverse sectional view of the machine taken on the line XI—XI of FIG. 1.
Figure 12:
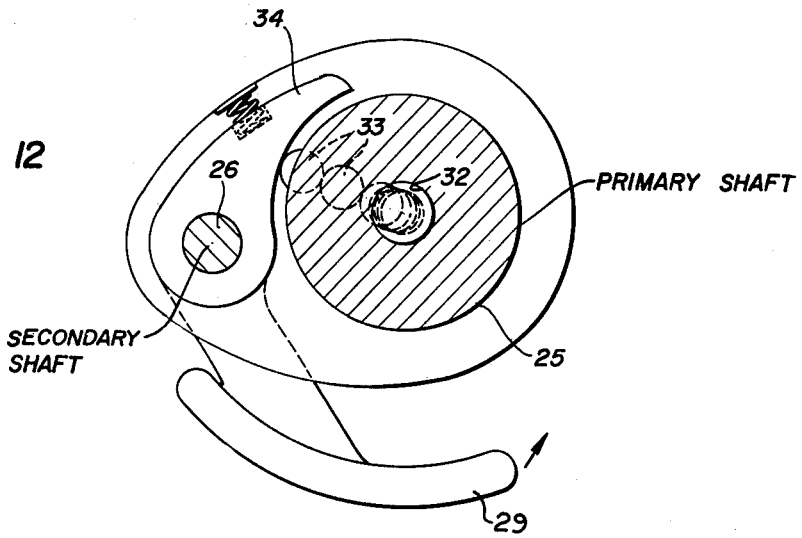
FIG. 12 is a sectional view of the invention taken on the line XII—XII of FIG. 11.

Referring now to FIGS. 11 and 12, it can be seen that the apparatus for carrying out step D, i.e., applying the gum portion 15 around the window 16 is carried out in the portion of the machine indicated in FIG. 1 by the section line XI—XI. A primary shaft 25 is rotatably mounted in and extends transversely of the frame 11, above the conveyor 12 and driven in synchronization therewith. A secondary shaft 26 is rotably mounted on the primary shaft with its axis parallel to and spaced from that of the primary shaft. A gum applicator 27 is fastened to the secondary shaft and takes part, not only in its rotation with the primary shaft 25, but also in its rotation about its own axis. Means is provided for producing the said rotation of the secondary shaft to move the applicator 27 from an operative position wherein rotation of the primary shaft causes the applicator to engage an envelope blank 13 on the conveyor 12 to an inoperative position wherein the applicator does not strike the conveyor.

A means for producing the rotation of the secondary shaft consists of a solenoid 28, connected to one end of a lever 29, whose center is pivotally connected to the frame. The other end of the lever operates on a plunger 31 operable in a center bore in the bore 32 extending coaxially of the primary shaft 25 and having a plurality of bearing balls 33 engaged on one end by the lever 29 and the plunger 31 and on the other end with an abutment 34 on the secondary shaft 26.

Figure 13:
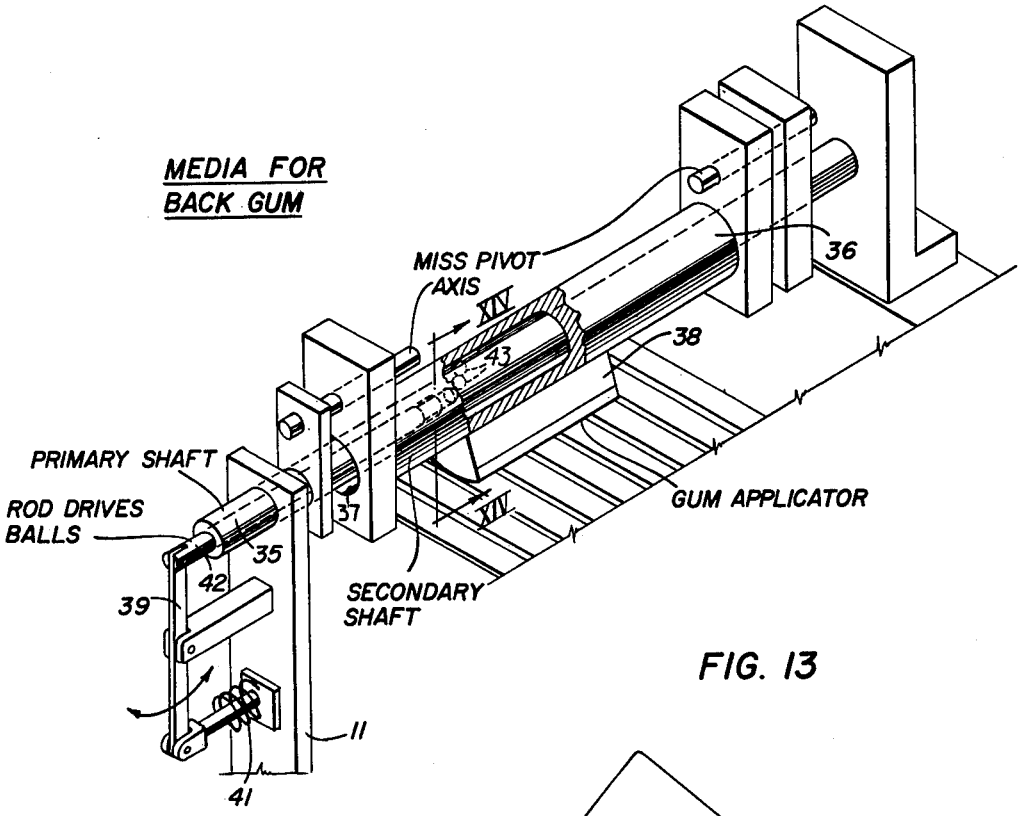
FIG. 13 is a perspective view of a further portion of this machine.
Figure 14:
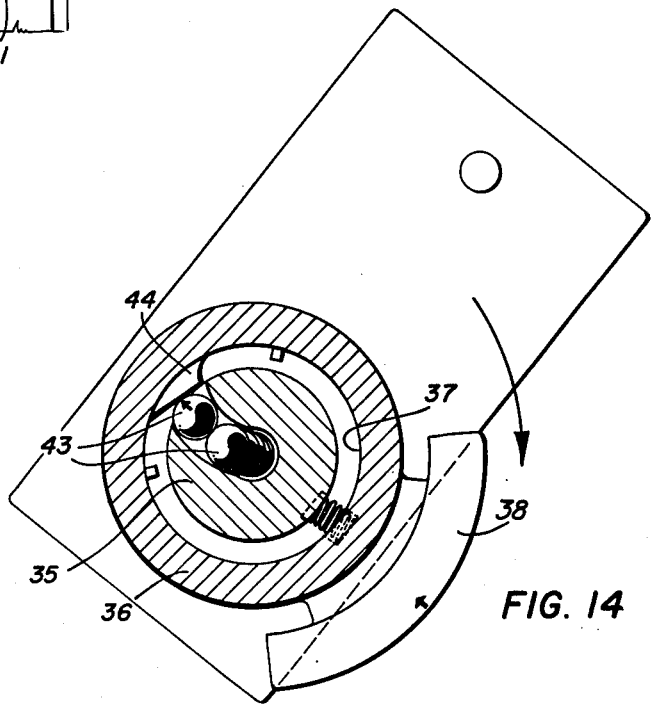
FIG. 14 is a sectional view taken on the line XIV—XIV of FIG. 13.

FIGS. 13 and 14 show the operation of the apparatus for providing the step I, that is to say, applying the back gummed portions 23 and 24. This apparatus consists of a primary shaft 35 which is rotatably mounted in and extends transversely of the frame 11 above the conveyor and driven in synchronization therewith. A secondary shaft 36 is rotatably mounted on the primary shaft 35 with the primary shaft extending through a bore 37 in the secondary shaft. The bore 37 has a substantially larger diameter than the primary shaft 35. The gum applicator 38 is mounted on the secondary shaft 36 and takes part in its rotation with the primary shaft. Means is provided for producing a lateral movement of the secondary shaft 36 relative to the primary shaft to bring about a movement of the applicator 38 from an operative position wherein rotation of the primary shaft causes the applicator to engage an envelope blank 13 on the conveyor to an inoperative position wherein the applicator does not strike the conveyor. This means consists of a lever 39, the central portion is pivotally mounted on the frame 11. At the lower end it is engaged by a solenoid 41 and at its upper end it engages a rod 42 which rides in a bore extending axially of the primary shaft 35 and engaging a line of ball bearings 43, the other end of which engages an abutment 44 formed in the inner surface of the bore 37 of the secondary shaft 36.

Figure 15:
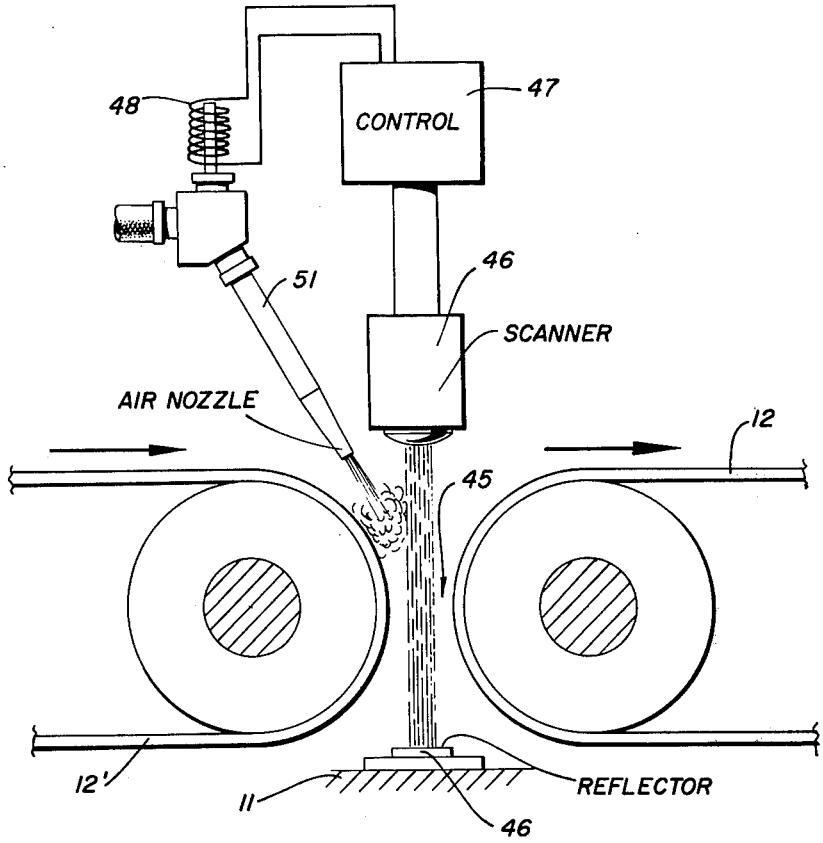
FIG. 15 is a longitudinal sectional view of the machine taken on the line XV—XV of FIG. 1, and FIGS. 16 and 17 are side elevational and front elevational views of a modified form of a conveyor.

FIG. 15 shows the manner in which window patches 17 that have not been applied to envelope blanks are removed from the machine. The conveyor which carries the envelope blanks 13 through the machine, is of course, divided into sections and the portion indicated in section XV—XV of FIG. 1 consists of a section 12', previously shown in FIG. 11 and a conveyor 12'', the discharge end of conveyor 12' being slightly spaced from the entrance end of the conveyor 12'' to define a gap 45. Mounted on the frame 11, below the gap 45, is a retro-reflective element 46, while above the gap is a scanner 47. The nature of the scanner and reflector are described in detail in the patent of Dunigan et al. U.S.

Pat. No. 3,227,886 which issued Jan. 4, 1966, they are provided with a control 47 which is operative when a light beam is able to leave the scanner 47, strike the reflector 46 and return to the scanner, as when no envelop blank exists in the gap 45. When such a situation exists the control 47 operates a solenoid 48 associated with a valve 49. The valve is connected by a conduit to a source of air under pressure, on the one hand and on the other hand to an air nozzle 51, located to cause a stream of air to flow into the gap 46.

Referring to FIG. 11, it can be seen that, when an envelope blank resides on the conveyor 12', a photo-cell 52 having a light beam passing through a gap in the conveyor 12' indicates this fact to a control 53. This operates through the solenoid 28 and the lever 29 as well as the ball bearings 33 to to render the applicator 27 operative. When the photo-cell 52, however, does not sense the presence of an envelope blank, because the light beam is reflected from a mirror, it operates through the ball bearings 33 to render the applicator 27 inoperative. This means that even though a window patch 17 is supplied onto the conveyor surface, nevertheless, no gum has been applied to the conveyor, since there is no envelope blank available to receive that gum. Furthermore, referring now to FIG. 15, assuming that there is no envelope blank to receive the window, the window when it arrives at the end of the conveyor 12' and starts to go across the gap 45 to the conveyor 12'' will receive a blast of air from the end nozzle 51, which will blow it down the gap into the underpart of the machine where it is rendered harmless. A receptacle for that purpose can be provided at that point.

Referring to FIGS. 13 and 14, a similar photo-cell indicator can indicate to the solenoid 41, that an envelope blank is missing in the area of the machine where the back gum is normally applied. This causes the lever 39 to operate through the ball bearings 43 to render the applicator 38 inoperative. In other words, it misses the upper surface of the conveyor by a considerable amount so that no gum is applied to the conveyor.

Figure 16:
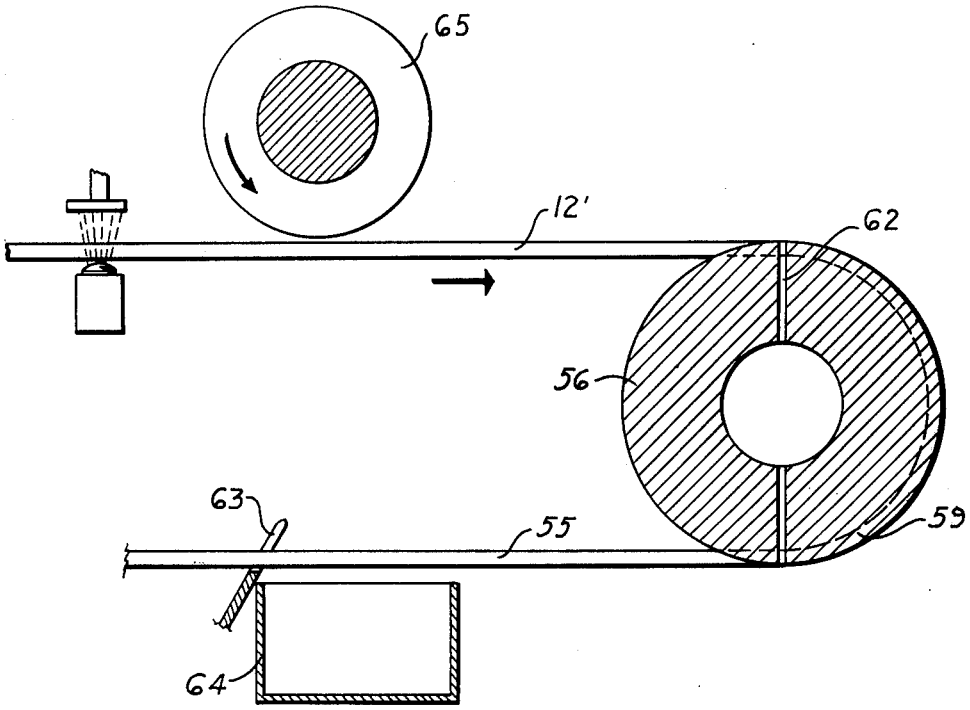
Figure 17:
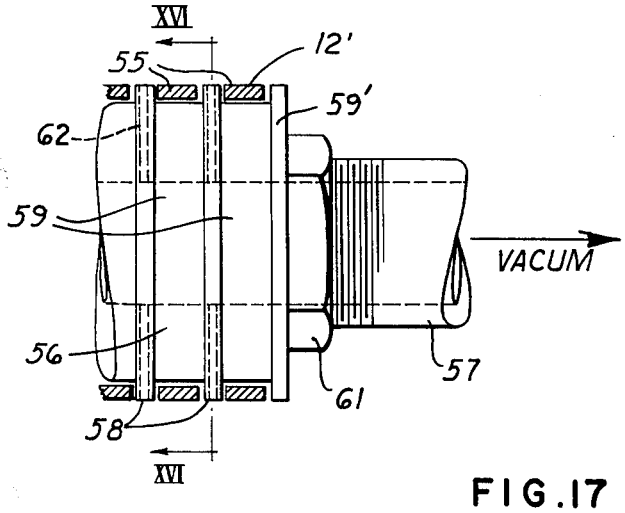

FIGS. 16 and 17 show an alternate means of disposing of a window patch. The conveyor 12' is similar to that shown in FIG. 11 in that it consists of a plurality of spaced, parallel belts 55 passing around a roller 56 and having small gaps between them to which suction is applied. The roller has a hollow main shaft 57 on which are mounted alternately washers 58 and spacers 59. The belts pass around the spacers and are maintained in spaced condition by the washers. The outer periphery of the washers is approximately on the same level as the outer surface of the belts. The washers and spacers are clamped tightly together by nuts 61 screwed on the ends of the main shaft. The main shaft is formed with a central bore which is supplied on occasion with vacuum; radial passages 62 extend from this bore to the outer periphery of the washers. A special washer 59' is located at each end and is not provided with suction passages. The underside of the conveyor 12' is provided with a comb 63 which has teeth extending through the gaps between the belts and with a receptable 64 to receive the unwanted window patches.

In operation, a window patch dispenser 65 of the well-known type is located above the conveyor some distance upstream from the roller 56. It drops a window patch on the upper surface of the conveyor even when an envelope blank is not present. However, when an envelope blank is not present, as indicated by a photo-cell arrangement similar to that shown in FIGS. 11 and 15, a suction is applied to the roller 56. The window patch is carried around the roller to the underside where it is disposed of, preferably by falling into the receptacle 64.

It can be seen that the envelope machine of the invention can be operated at a very rapid rate without interruption. No gum will be applied to the gummer or conveyor 12' when the envelope blank is missing and furthermore, no window will pass down stream through the machine. Similarly, no gum will be applied to the conveyor in the vicinity of the applicator 38, which is the back gum applicator when an envelope blank is missing, so that the gum is not carried into the package of envelopes that is ultimately assembled. It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. An envelope machine, comprising:

a. an elongated frame, b. a conveyor mounted in the frame for carrying envelope blanks longitudinally of the frame, the conveyor consisting of a plurality of endless belts mounted side-by-side to define gaps between them and a suction means including a tray underlying the upper run of the belts to provide suction in the gaps, the tray being open upwardly and having vertical side walls whose upper edges extend longitudinally in sealing relationship with the two extreme side belts, and c. a blank processing element mounted on the frame above the conveyor and spaced upstream a substantial distance from the discharge end of the conveyor.

* * * * *